US009989019B2

(12) United States Patent
Makino

(10) Patent No.: US 9,989,019 B2
(45) Date of Patent: Jun. 5, 2018

(54) FUEL VAPOR RECOVERY APPARATUS

(71) Applicant: AISAN KOGYO KABUSHIKI KAISHA, Obu-shi, Aichi-ken (JP)

(72) Inventor: Katsuhiko Makino, Aichi-ken (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 21 days.

(21) Appl. No.: 15/010,743

(22) Filed: Jan. 29, 2016

(65) Prior Publication Data

US 2016/0258389 A1 Sep. 8, 2016

(30) Foreign Application Priority Data

Mar. 6, 2015 (JP) ..... 2015-044479

(51) Int. Cl.
*F02M 25/08* (2006.01)

(52) U.S. Cl.
CPC ..... *F02M 25/0836* (2013.01)

(58) Field of Classification Search
CPC ..... F02M 25/0836; F02M 25/089; F02M 25/0854
See application file for complete search history.

(56) References Cited

U.S. PATENT DOCUMENTS 6,761,154 B2 * 7/2004 Takagi ..... F02M 25/0818 123/198 D
2004/0175268 A1 * 9/2004 Raymond ..... F01C 21/0836 415/206
2006/0225713 A1 * 10/2006 Kano ..... F02D 41/0032 123/520
2006/0278201 A1 * 12/2006 Nakamura ..... F02M 25/0818 123/519
2007/0137622 A1 * 6/2007 Koyama ..... F02D 41/0045 123/520
2014/0182360 A1 * 7/2014 Horiba ..... G01M 3/2876 73/40.5 R (Continued)

FOREIGN PATENT DOCUMENTS

JP 2007-32523 A 2/2007
JP 2007-177728 A 7/2007
JP 2008-240641 A 10/2008

*Primary Examiner* — Joseph Dallo
*Assistant Examiner* — Kurt Liethen
(74) *Attorney, Agent, or Firm* — Conley Rose, P.C.

(57) ABSTRACT

A fuel vapor recovery apparatus includes an adsorbent canister capable of capturing fuel vapor, a vapor passage connecting the adsorbent canister to a fuel tank. In addition, the apparatus includes an atmospheric air passage communicating the adsorbent canister with the atmosphere, a purge passage coupling the adsorbent canister to an intake pipe of an internal combustion engine, a purge pump configured to generate a gas flow from the adsorbent canister to the intake pipe through the purge passage, and a flow control valve provided at the purge passage downstream of the purge pump in a direction of the gas flow and configured to regulate the gas flow through the purge passage. Further, the apparatus includes a decompressor configured to decrease pressure upstream of the flow control valve when the pressure upstream of the flow control valve in the direction of the gas flow is higher than the atmospheric pressure.

1 Claim, 5 Drawing Sheets

(56) References Cited

U.S. PATENT DOCUMENTS

2016/0017849 A1* 1/2016 Shirai ..... F02D 41/004
123/520
2016/0201615 A1* 7/2016 Pursifull ..... F02M 35/104
123/520

* cited by examiner

FUEL VAPOR RECOVERY APPARATUS

CROSS-REFERENCE TO RELATED APPLICATIONS

This application claims priority to Japanese patent application serial number 2015-044479, filed Mar. 6, 2015, the contents of which are incorporated herein by reference in their entirety for all purposes.

STATEMENT REGARDING FEDERALLY SPONSORED RESEARCH OR DEVELOPMENT

Not applicable.

BACKGROUND

This disclosure relates to a fuel vapor recovery apparatus including an adsorbent canister capable of capturing fuel vapor, a vapor passage introducing the fuel vapor produced in a fuel tank to the adsorbent canister, an atmospheric air passage fluidly communicating the adsorbent canister with the atmosphere, and a purge passage introducing the fuel vapor captured in the adsorbent canister to an intake pipe of an internal combustion engine.

Japanese Laid-Open Patent Publication No. 2007-177728 discloses a conventional fuel vapor recovery apparatus. Referring to FIG. 6, such conventional fuel vapor recovery apparatus 100 has an adsorbent canister 102 capable of trapping fuel vapor, a vapor passage 104 introducing the fuel vapor produced in a fuel tank 103 to the adsorbent canister 102, an atmospheric air passage 105 fluidly communicating the adsorbent canister 102 with the atmosphere, and a purge passage 107 introducing the fuel vapor captured in the adsorbent canister 102 to an intake pipe 120 of an internal combustion engine (not shown). The purge passage 107 is provided with a purge pump 110 for generating gas flow from the adsorbent canister 102 through the purge passage 107 to the intake pipe 120 of the engine. The purge passage 107 is further provided with a flow control valve 112 downstream of the purge pump 110. According to the above-described configuration, when the purge pump 110 is started under a condition where the engine is running, the atmospheric air can be drawn into the adsorbent canister 102 through the atmospheric air passage 105 in order to forcibly purge the fuel vapor captured in the adsorbent canister 102 and introduce the fuel vapor into the intake pipe 120 of the engine. During this operation, the flow control valve 112 can regulate a flow rate of the gas flowing through the purge passage 107 toward the intake pipe 120 of the engine.

The fuel vapor recovery apparatus 100 is configured such that when the purge pump 110 provided along the purge passage 107 is driven, the fuel vapor adsorbed in the adsorbent canister 102 is forcibly purged by the air. Thus, there is a possibility that inner pressure of the purge passage 107 upstream of the flow control valve 112 becomes higher than the atmospheric pressure. When the engine is stopped under a condition where the inner pressure of the purge passage 107 is higher than the atmospheric pressure, the inner pressure of the adsorbent canister 102 fluidly communicating with the purge passage 107 might become higher than the atmospheric pressure after the purge pump 110 is stopped. Accordingly, there is a possibility that the fuel vapor adsorbed in the adsorbent canister 102 might flow into the atmosphere through the atmospheric air passage 105. Therefore, there has been a need for an improved fuel vapor recovery apparatus.

BRIEF SUMMARY

In one aspect of this disclosure, a fuel vapor recovery apparatus includes an adsorbent canister capable of capturing fuel vapor, a vapor passage connecting the adsorbent canister to a fuel tank, an atmospheric air passage communicating the adsorbent canister with the atmosphere, a purge passage coupling the adsorbent canister to an intake pipe of an internal combustion engine, a purge pump configured to generate a gas flow from the adsorbent canister to the intake pipe through the purge passage, a flow control valve provided at the purge passage downstream of the purge pump in a direction of the gas flow and configured to regulate the gas flow through the purge passage, and a decompressor configured to decrease pressure upstream of the flow control valve in the direction of the gas flow when the pressure upstream of the flow control valve in the direction of the gas flow is higher than the atmospheric pressure.

According to this aspect of the present disclosure, when the pressure upstream of the flow control valve in the gas flow is higher than the atmospheric pressure under a condition where the gas flow from the adsorbent canister to the intake pipe of the engine through the purge passage is generated, the decompressor decreases the pressure upstream of the flow control valve. Thus, while the engine is running, the pressure upstream of the flow control valve, that is, the pressure in the purge passage, the adsorbent canister and the fuel tank is kept equal to or lower than the atmospheric pressure. Accordingly, when the engine and the purge pump are stopped, the pressure upstream of the flow control valve does not become higher than the atmosphere. Therefore, the diffusion of the fuel vapor from the adsorbent canister to the atmosphere through the atmospheric air passage can be prevented or reduced.

DETAILED DESCRIPTION

Each of the additional features and teachings disclosed above and below may be utilized separately or in conjunction with other features and teachings to provide improved fuel vapor recovery apparatuses. Representative examples, which utilize many of these additional features and teachings both separately and in conjunction with one another, will now be described in detail with reference to the attached drawings. This detailed description is merely intended to teach a person of skilled in the art further details for practicing preferred aspects of the present teachings and is not intended to limit the scope of the invention. Only the claims define the scope of the claimed invention. Therefore, combinations of features and steps disclosed in the following detailed description may not be necessary in the broadest sense, and are instead taught merely to particularly describe representative examples. Moreover, various features of the representative examples and the dependent claims may be combined in ways that are not specifically enumerated in order to provide additional useful embodiments of the present teachings.

Figure 1:
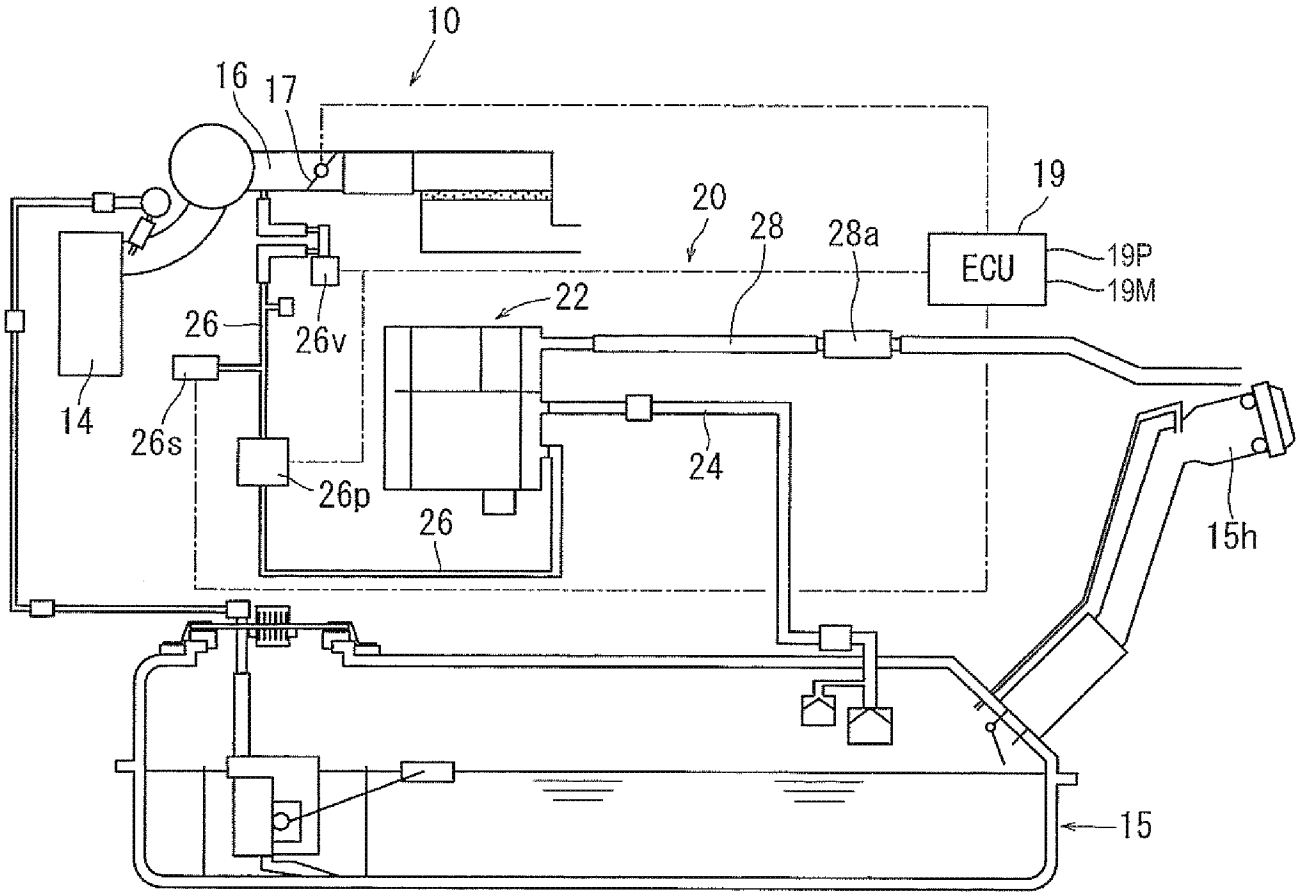
FIG. 1 is a schematic diagram of a fuel vapor recovery apparatus according to a first embodiment.

A fuel vapor recovery apparatus 20 according to a first embodiment will be described based on FIGS. 1 and 2. Referring to FIG. 1, the fuel vapor recovery apparatus 20 is combined with an engine system 10 for a vehicle and is configured to prevent fuel vapor produced in a fuel tank 15 of the vehicle from leaking into the outside.

Figure 2:
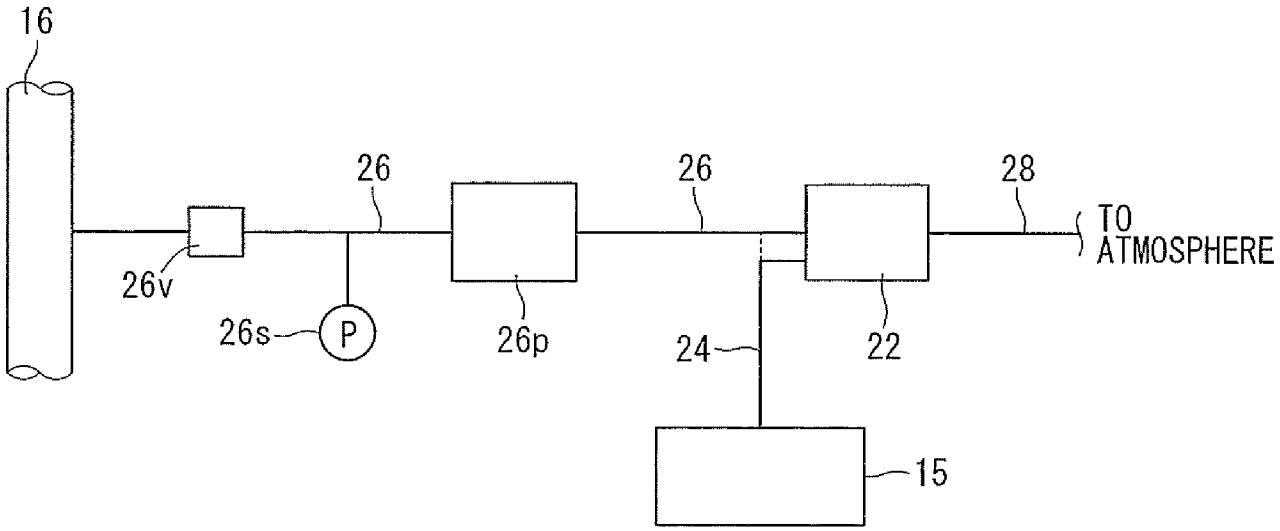
FIG. 2 is a schematic diagram of a part of the fuel vapor recovery apparatus.

As shown in FIGS. 1 and 2, the fuel vapor recovery apparatus 20 includes an adsorbent canister 22, a vapor passage 24, a purge passage 26 and an atmospheric air passage 28. Each of the vapor passage 24, the purge passage 26 and the atmospheric air passage 28 is coupled to the adsorbent canister 22. The adsorbent canister 22 is filled with an adsorbent (not shown), such as an activated carbon, for adsorbing fuel vapor produced in the fuel tank 15. The vapor passage 24 is configured to introduce the fuel vapor from the fuel tank 15 to the adsorbent canister 22. One end (upstream end) of the vapor passage 24 is fluidly communicated with an air layer in the fuel tank 15, and the other end (downstream end) of the vapor passage 24 is fluidly communicated with the inside of the adsorbent canister 22. The atmospheric air passage 28 is configured to communicate the adsorbent canister 22 with the atmosphere. A base end of the atmospheric air passage 28 is coupled to the adsorbent canister 22, and the other end of the atmospheric air passage 28 is open to the atmosphere at a position near a fill opening 15*h* of the fuel tank 15. An air filter 28*a* is provided in the middle of the atmospheric air passage 28.

The purge passage 26 is configured to introduce the fuel vapor from the adsorbent canister 22 to an intake pipe 16 of an internal combustion engine 14 (referred to as "engine", hereinafter). The purge passage 26 has one end (upstream end) fluidly communicating the inside of the adsorbent canister 22 and the other end (downstream end) fluidly communicating the intake pipe 16 downstream of a throttle valve 17. The purge passage 26 has a purge pump 26*p*, a pressure sensor 26*s* and a flow control valve 26*v* in order from the upstream end to the downstream end. The purge pump 26*p* is operated based on signals output from an engine control unit (ECU) 19 and is configured to produce a gas flow from the adsorbent canister 22 through the purge passage 26 to the intake pipe 16 of the engine 14 while the engine 14 is running. The pressure sensor 26*s* is configured to measure the inner pressure of the purge passage 26 upstream of the flow control valve 26*v* and to output pressure detection signals to the ECU 19. The flow control valve 26*v* is configured to regulate the flow rate of the gas flowing through the purge passage 26 while the purge pump 26*p* is driven. The flow control valve 26 is operated based on signals output from the ECU 19.

When the engine 14 of the vehicle is stopped, the flow control valve 26*v* is closed in order to block fluid communication through the purge passage 26, and the purge pump 26*p* is stopped. Thus, the fuel vapor vaporized in the fuel tank 15 is introduced into the adsorbent canister 22 through the vapor passage 24 and is adsorbed on the adsorbent filled in the adsorbent canister 22. Then, after starting engine 14, when predetermined purge conditions are satisfied, the ECU 19 performs an operation for purging the fuel vapor adsorbed on the adsorbent in the adsorbent canister 22.

During this operation, the purge pump 26*p* is driven and the flow control valve 26*v* is opened. Thus, negative pressure generated at an inlet side (upstream side) of the purge pump 26*p* is applied to the adsorbent canister 22, so that inner pressure of the adsorbent canister 22 becomes negative. Accordingly, the air flows into the adsorbent canister 22 through the atmospheric air passage 28. Further, gases flow from the fuel tank 15 into the adsorbent canister 22, so that the fuel tank 15 is depressurized. A mixture of the air and the gases, flowing into the adsorbent canister 22, purges the fuel vapor adsorbed on the adsorbent and is introduced into the purge pump 26*p* through the purge passage 26 together with the fuel vapor. Then, the mixture containing the fuel vapor is pressurized by the purge pump 26*p* and is supplied to the intake pipe 16 of the engine 14 via the flow control valve 26*v* and the downstream end of the purge passage 26. That is, the fuel vapor removed from the adsorbent filled in the adsorbent canister 22 is introduced into the intake pipe 16 of the engine 14 together with the air and is burned in the engine 14. During this operation, the ECU 19 controls the opening amount of the flow control valve 26*v* in order to regulate the air-fuel ratio of an air-fuel mixture supplied to the engine 14.

When the purge pump 26*p* is driven, the mixture containing the fuel vapor is pressurized by the purge pump 26*p* and is supplied to the intake pipe 16 of the engine 14 via the flow control valve 26*v* and the purge passage 26. During this operation, because the intake pipe 14 of the engine 16 is fluidly communicated with the purge passage 26, inner pressure of the purge passage 26 downstream of the flow control valve 26*v* is constantly negative due to the negative pressure in the intake pipe 16. Whereas, although the negative pressure in the intake pipe 16 of the engine 14 is applied to the purge passage 26 upstream of the flow control valve 26*v* via the flow control valve 26*v*, the inner pressure of the purge passage 26 upstream of the flow control valve 26*v* might be higher than the atmospheric pressure due to discharge pressure (positive pressure) of the purge pump 26*p*. When the engine 14 and the purge pump 26*p* are stopped under a condition where the pressure P in the purge passage 26 upstream of the flow control valve 26*v* is positive (i.e., P>0 kPa in gauge pressure), the inner pressure of the adsorbent canister 22 fluidly communicating the purge passage 26 might become positive. Thus, there is a possibility that the fuel vapor trapped in the adsorbent canister 22 may diffuse to the outside atmosphere through the atmospheric air passage 28. The ECU 19 is configured to perform a decompression control for preventing such diffusion of the fuel vapor. The ECU 19 includes a memory for storing control programs and a processor for executing the control program, so that the decompression control is operated based on the control programs stored in the memory of the ECU 19.

That is, the ECU 19 monitors the pressure in the purge passage 26 upstream of the flow control valve 26*v* (and downstream of the purge pump 26*p*) by using the pressure sensor 26*s*. When the pressure in the purge passage 26 becomes positive, the ECU 19 performs the decompression control in order to decrease the pressure in the purge passage 26 upstream of the flow control valve 26*v*. The decompression control includes decreasing the rotation number N of the purge pump 26*p* (e.g., rotation number N may be the revolutions of the purge pump 26*p* impeller per some unit time), increasing the valve opening amount of the flow control valve 26*v*, and decreasing the pressure in the intake pipe 16 of the engine 14.

To decrease the rotation number N of the purge pump 26*p*, the ECU 19 may decrease voltage applied to a driving motor of the purge pump 26*p*. Thus, the rotation number of the driving motor is decreased, so that the rotation number N of the purge pump 26*p* is also decreased. When the rotation number N of the purge pump 26*p* decreases, the discharge pressure of the purge pump 26*p* decreases such that the pressure in the purge passage 26 upstream of the flow control valve 26*v* decreases. Further, when the ECU 19 increases the valve opening amount of the flow control valve 26*v*, pressure loss at the flow control valve 26*v* decreases. Accordingly, influence of the negative pressure in the intake pipe 16 of the engine 14 on the pressure in the purge passage 26 upstream of the flow control valve 26*v* becomes greater, so that differential pressure between the pressure in the intake pipe 16 and the pressure in the purge passage 26 upstream of the flow control valve 26*v* decreases. Consequently, the pressure in the purge passage 26 upstream of the flow control valve 26*v* decreases.

To decrease the pressure in the intake pipe 16 of the engine 14, the ECU 19 may perform a control operation for decreasing the circulating volume of exhaust gas or changing the circulation timing of the exhaust gas in an exhaust gas recirculation system (EGR), or for increasing the rotation number of the engine 14 (e.g., the rotation number of engine 14 may be the number of revolutions of an output shaft of engine 14 per some unit time), etc. Because the intake pipe 16 of the engine 14 is in fluid communication with the purge passage 26, when the pressure in the intake pipe 16 of the engine 14 is lowered, the pressure in the purge passage 26 is also decreased. Accordingly, when the decompression control is carried out by decreasing the pressure in the intake pipe 16, the pressure in the purge passage 26 upstream of the flow control valve 26*v* decreases.

The decompression control can be performed by carrying out any one of decreasing the rotation number N of the purge pump 26*p*, increasing the valve opening amount of the flow control valve 26*v* and decreasing the pressure in the intake pipe 16 of the engine 14, or by simultaneously or sequentially carrying out at least two of them. Because of the decompression control, the pressure in the purge passage 26 upstream of the flow control valve 26*v* can be efficiently decreased while the purge pump 26 is running. That is, the ECU 19 corresponds to a decompressor of this disclosure.

According to the fuel vapor recovery apparatus 20, under a condition where gas flows from the adsorbent canister 22 to the intake pipe 16 of the engine 14 through the purge passage 26, when the pressure upstream of the flow control valve 26*v* becomes higher than the atmospheric pressure, the ECU 19 performs the decompression control in order to decrease the pressure upstream of the flow control valve 26*v*. Thus, while the engine 14 is running, it is able to prevent the pressure upstream of the flow control valve 26*v*, i.e., the pressure in the fuel tank 15, the adsorbent canister 22 and the purge passage 26 upstream of the flow control valve 26*v*, from remaining at a higher pressure than the atmospheric pressure. Accordingly, after the engine 14 and the purge pump 26*p* are stopped, the inner pressure of the purge passage 26, the adsorbent canister 22 and others does not become higher than the atmospheric pressure. Therefore, the diffusion of the fuel vapor from the adsorbent canister 22 to the atmosphere through the atmospheric air passage 28 can be prevented or reduced. Further, because the pressure sensor 26*s* is provided for measuring the pressure in the purge passage 26 upstream of the flow control valve 26*v*, the pressure upstream of the flow control valve 26*v* can be accurately detected.

In the first embodiment, the pressure sensor 26*s* is provided along the purge passage 26 upstream of the flow control valve 26*v* such that based on the pressure signals output from the pressure sensor 26*s*, the ECU 19 performs the decompression control by decreasing the rotation number N of the purge pump 26*p*, increasing the valve opening amount of the flow control valve 26*v* and/or decreasing the pressure in the intake pipe 16 of the engine 14. Whereas, the ECU 19 can be modified to carry out the decompression control based on a map that is prepared based on a relationship between the pressure in the purge passage 26 upstream of the flow control valve 26*v*, the rotation number N of the purge pump 26*p*, the negative pressure (kPa) in the intake pipe 16 of the engine 14 and the valve opening amount (%) of the flow control valve 26*v* in order to prevent the pressure upstream of the flow control valve 26*v* from becoming positive.

Figure 3:
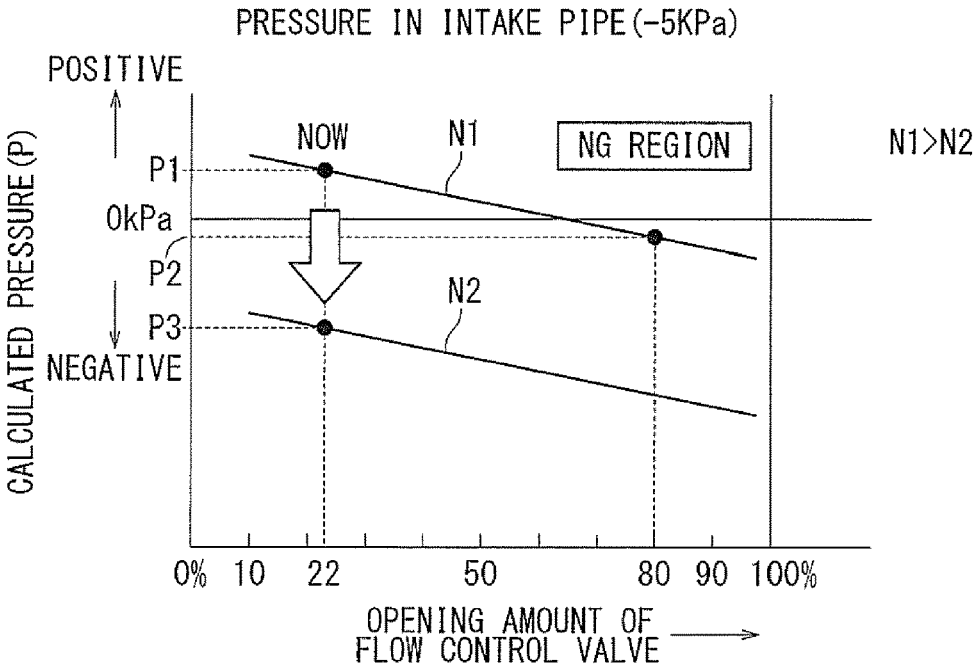
FIG. 3 is a map used for a decompression control of the fuel vapor recovery apparatus according to a second embodiment.

In a second embodiment, the ECU 19 may store a first map shown in FIG. 3 and perform the decompression control based on the first map. The first map of FIG. 3 shows the calculated pressure P in the purge passage 26 upstream of the flow control valve 26*v*, which is estimated based on the rotation number N of the purge pump 26*p* and the valve opening amount (%) of the flow control valve 26*v* under a condition where the pressure in the intake pipe 16 of the engine 14 is kept at −5 kPa. According to the first map, when the valve opening amount of the flow control valve 26*v* is 22% and the rotation number of the purge pump 26*p* is N1, the pressure P in the purge passage 26 is P1 (P1>0 kPa, i.e., positive pressure), so that the decompression control is required. In this state, by increasing the valve opening amount of the flow control valve 26*v* to 80% while keeping the rotation number of the purge pump 26*p* at N1, the pressure P in the purge passage 26 is presumed to decrease to P2 (P2<0 kPa, i.e., negative pressure). Alternatively, by decreasing the rotation number of the purge pump 26*p* to N2 (N2<N1) while keeping the valve opening amount of the flow control valve 26*v* at 22%, the pressure P in the purge passage 26 is presumed to decrease to P3 (P3<0 kPa, i.e., negative pressure).

Figure 4:
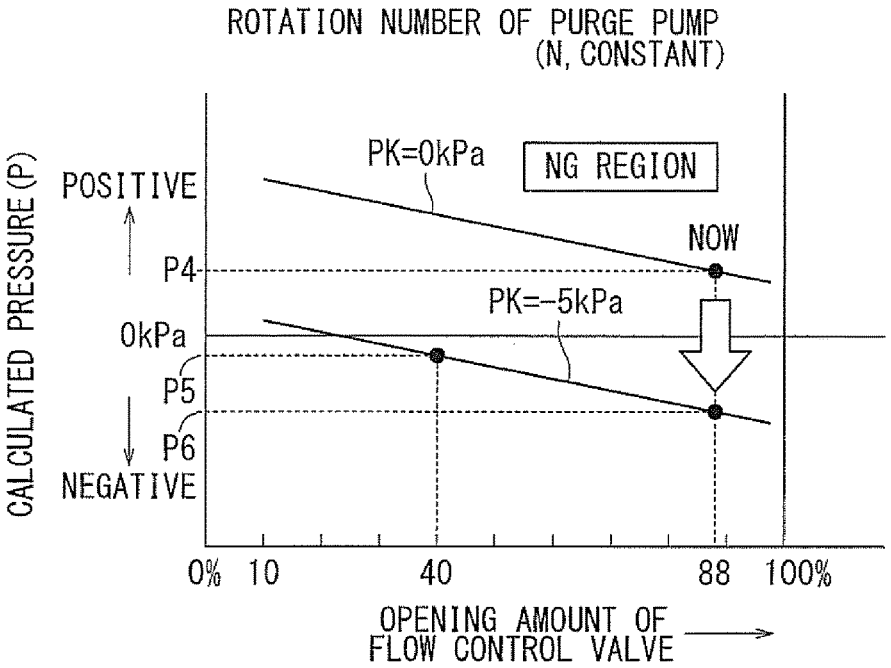
FIG. 4 is another map used for the decompression control of the fuel vapor recovery apparatus.

Further, the ECU 19 may store a second map shown in FIG. 4 and perform the decompression control based on the second map. The second map of FIG. 4 shows the calculated pressure P in the purge passage 26, which is estimated based on the pressure PK in the intake pipe 16 of the engine 14 and the valve opening amount (%) of the flow control valve 26*v* under a condition where the rotation number N of the purge pump 26*p* is maintained constant. According to the second map, when the valve opening amount of the flow control valve 26*v* is 88% and the pressure PK in the intake pipe 16 is 0 kPa, the pressure P in the purge passage 26 is P4 (P4>0 kPa, i.e., positive pressure), so that the decompression control is required. In this state, by decreasing the pressure PK in the intake pipe 16 of the engine 14 to −5 kPa while keeping the valve opening amount of the flow control valve 26*v* at 88%, the pressure P in the purge passage 26 is presumed to decrease to P6 (P6<0 kPa, i.e., negative pressure). Further, under the condition where the pressure PK in the intake pipe 16 of the engine 14 is −5 kPa, when the valve opening amount of the flow control valve 26*v* is decreased to 40%, the pressure in the purge passage 26 is presumed to be P5 (P6<P5<0 kPa) and thus can be kept in negative. According to the second embodiment, the pressure P in the purge passage 26 upstream of the flow control valve 26*v* can be estimated depending on the maps shown in FIGS. 3 and 4, so that the pressure sensor 26*s* can be omitted in order to cut production cost of the fuel vapor recovery apparatus 20.

Figure 5:
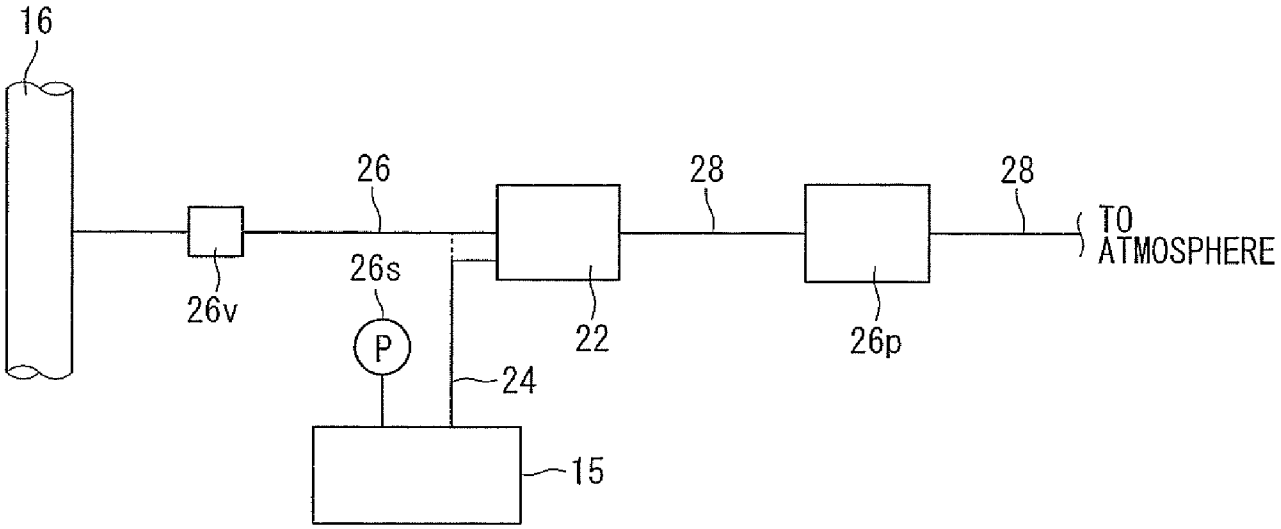
FIG. 5 is a schematic diagram of a part of the fuel vapor recovery apparatus according to a third embodiment.
Figure 6:
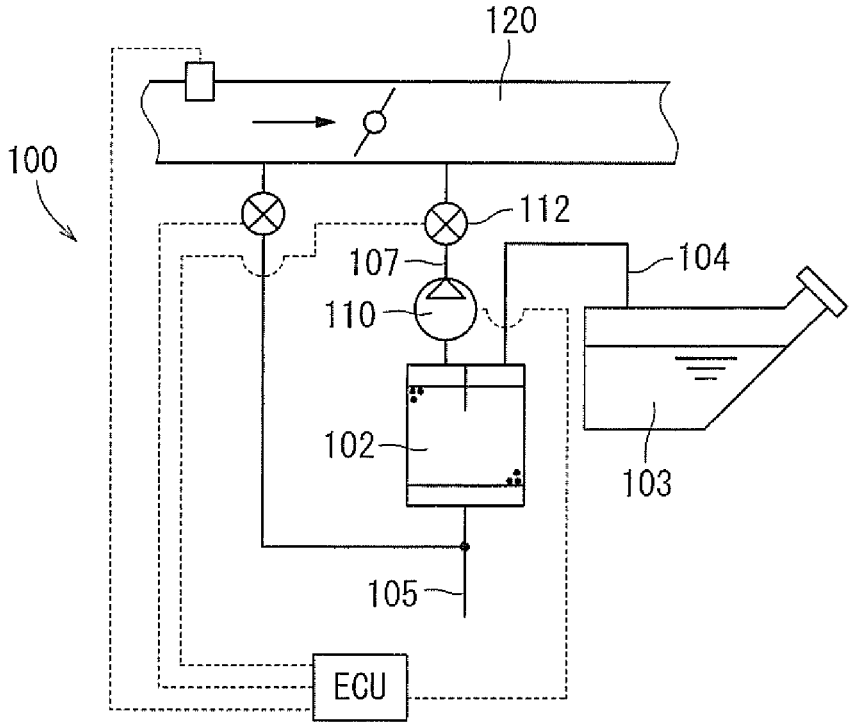
FIG. 6 PRIOR ART
FIG. 6 is a schematic diagram of the conventional fuel vapor recovery apparatus.

Further, the above-described embodiments can be modified variously. For example, in a third embodiment as shown in FIG. 5, the pressure sensor 26*s* may be provided at the fuel tank 15 located at a position upstream of the purge passage

26 and the adsorbent canister 22 for detecting inner pressure of the fuel tank 15. And, the purge pump 26*p* may be located along the atmospheric air passage 28 upstream of the adsorbent canister 22. In addition, the vapor passage 24 and the purge passage 26 may be directly coupled to each other as shown by each dashed line in FIGS. 2 and 5.

What is claimed is:

1. A fuel vapor recovery apparatus comprising:

an adsorbent canister capable of capturing fuel vapor;

a vapor passage connecting the adsorbent canister to a fuel tank;

an atmospheric air passage communicating the adsorbent canister with the atmosphere;

a purge passage coupling the adsorbent canister to an intake pipe of an internal combustion engine;

a purge pump configured to generate a gas flow from the adsorbent canister to the intake pipe through the purge passage;

a flow control valve provided at the purge passage downstream of the purge pump in a direction of the gas flow and configured to regulate the gas flow through the purge passage;

a pressure sensor located at the purge passage between the flow control valve and the purge pump; and a control unit including a memory for storing control programs and a processor for executing the control programs, the control unit configured to receive signals from the pressure sensor and to detect a situation in which the pressure upstream of the flow control valve is higher than an atmospheric pressure by using the signals from the pressure sensor, and the control unit configured to decrease pressure upstream of the flow control valve in the direction of the gas flow when the pressure upstream of the flow control valve in the direction of the gas flow is higher than the atmospheric pressure based on the control programs, wherein the control unit is configured to carry out at least one of decreasing a rotation number of the purge pump, decreasing pressure in the intake pipe of the engine, and increasing a valve opening amount of the flow control valve in order to decrease the pressure upstream of the flow control valve.

* * * * *